US011306652B1

(12) United States Patent
Westerbeke, Jr.

(10) Patent No.: US 11,306,652 B1
(45) Date of Patent: Apr. 19, 2022

(54) SMALL DIESEL ENGINE-GENERATOR SET

(71) Applicant: Westerbeke Corporation, Taunton, MA (US)

(72) Inventor: John H. Westerbeke, Jr., Milton, MA (US)

(73) Assignee: Westerbeke Corporation, Taunton, MA (US)

( * ) Notice: Subject to any disclaimer, the term of this patent is extended or adjusted under 35 U.S.C. 154(b) by 0 days.

(21) Appl. No.: 16/748,574

(22) Filed: Jan. 21, 2020

Related U.S. Application Data

(60) Provisional application No. 62/795,131, filed on Jan. 22, 2019.

(51) Int. Cl.
*F02B 63/04* (2006.01)
*F02B 75/16* (2006.01)
*B63H 8/50* (2020.01)

(52) U.S. Cl.
CPC ..... *F02B 63/042* (2013.01); *F02B 63/043* (2013.01); *F02B 63/048* (2013.01); *F02B 75/16* (2013.01); *B63H 8/50* (2020.02)

(58) Field of Classification Search
None
See application file for complete search history.

(56) References Cited

U.S. PATENT DOCUMENTS 4,622,923 A * 11/1986 Nishimura ..... F02B 63/04 123/198 E
6,158,416 A * 12/2000 Chen ..... F02D 41/401 123/380
6,309,268 B1 10/2001 Mabru
6,655,341 B2 12/2003 Westerbeke, Jr.
6,705,267 B1 3/2004 Westerbeke, Jr. et al.
6,799,422 B2 10/2004 Westerbeke, Jr. et al.
7,005,756 B2 2/2006 Westerbeke, Jr.
7,311,066 B1 12/2007 Westerbeke, Jr.
7,832,196 B2 11/2010 Westerbeke, Jr.
8,186,331 B2 * 5/2012 Falkowski ..... F02P 7/06 123/406.58
8,839,611 B2 * 9/2014 Turpin ..... F01N 3/046 60/298

(Continued)

FOREIGN PATENT DOCUMENTS

WO WO 2000153666 7/2001
WO WO 2002045189 6/2002
WO WO 2004018857 3/2004

OTHER PUBLICATIONS

Fischerpanda.com [online], "Marine Generator Manual—Panda 4K PMS; Panda 5K PMS—230 V/50 Hz; 120 V/60 Hz—Super silent technology," Feb. 9, 2016, [Retrieved on Sep. 2, 2020], retrieved from: URL<https://fischerpanda.com/wp-content/uploads/2015/04/FPO1-0007736.pdf>, 168 pages.

(Continued)

*Primary Examiner* — Grant Moubry
(74) *Attorney, Agent, or Firm* — Fish & Richardson P.C.

(57) ABSTRACT

An engine-generator set with a single-cylinder diesel engine and an electrical generator with a rotor secured to the engine crankshaft. The rotor is cantilevered on an end of the crankshaft. The engine has an electrically activatable fuel injector connected to a continuously pressurized fuel supply, such as in a common rail injection system. The engine exhaust passes through a catalyst bed. In a marine version, the catalyst bed is disposed within an injection elbow.

19 Claims, 3 Drawing Sheets

(56) References Cited

U.S. PATENT DOCUMENTS

| | | | | |
|---|---|---|---|---|
| 9,048,765 | B2 * | 6/2015 | Dobbs | F02D 41/0007 |
| 9,074,503 | B2 * | 7/2015 | Sputh | F01N 3/04 |
| 2012/0067304 | A1 * | 3/2012 | Littmann | F02B 43/10 123/3 |
| 2014/0277791 | A1 * | 9/2014 | Lenard | H02J 7/34 700/287 |
| 2015/0226101 | A1 * | 8/2015 | Nishimura | F01N 3/103 123/41.44 |
| 2015/0260095 | A1 * | 9/2015 | Hinderks | B63H 5/125 123/568.11 |
| 2018/0145559 | A1 * | 5/2018 | Johnson | F16H 57/025 |
| 2018/0183263 | A1 * | 6/2018 | Wang | H02J 9/061 |

OTHER PUBLICATIONS

Fischerpanda.de [online], "Marine Generator Manual—Panda 5000i. Neo PMS—Super silent technology—230 V 50 Hz 5kVA; 120 V 60 Hz 5kVA; 110 V 60 Hz 5kVA," Jun. 6, 2017, [Retrieved on Sep. 2, 2020], retrieved from: URL<https ://www.fischerpanda.de/images/gensets/docs/FPO1-0010653.pdf>, 144 pages.

Marinea.fi [online], "User's Manual—M-GV4 Piccolo—High-efficiency 4kW Genverter for marine use," Whisperpower, Oct. 2016, [Retrieved on Sep. 2, 2020], retrieved from: URL<https://www.marinea.fi/files/products/wp-product-groep-download-270-0a-40200821-EN-M-GV4-Piccolo-User-20161014.pdI>, 28 pages.

Masenorthamerica.com [online], "IS 2500-3500; IS 4500-5500—Usage and Maintenance Manual," updated on Mar. 3, 1998, [Retrieved on Sep. 2, 2020], retrieved from: URL<http://www.masenorthamerica.com/manuals/old-literature/UM/40941 UM%20IS%202500-5500.pdf>, 44 pages (with English Translation).

Sflot.ru [online], "MASTERVOLT—Users Manuel—Whisper 3.5M—3000 RPM—Marine diesel generating set 230V / 50Hz—MasterBus controlled," Dec. 2009, [Retrieved on Sep. 2, 2020], retrieved from: URL<https://sflot.ru/assets/storage/files/218/1218/USERS_MANUAL_W3_5.pdf>, 40 pages.

* cited by examiner

SMALL DIESEL ENGINE-GENERATOR SET

CROSS-REFERENCE TO RELATED APPLICATIONS

This application claims the benefit under 35 U.S.C. § 119(e) of U.S. Patent Application No. 62/795,131, entitled "Triggering Answer Boxes," filed Jan. 22, 2019, which is incorporated herein by reference in its entirety.

TECHNICAL FIELD

This invention relates to diesel-powered engine-generator sets, and more particularly to those with single cylinder engines.

BACKGROUND

Engine-generator sets combust fuel to generate electricity. Some such sets have gasoline engines. Others run on diesel, and some others run on propane or compressed natural gas. The principal use of such sets is to generate electrical power far from any power grid, such as on a vehicle. Long-haul trucks may have such a system to provide electric power to run HVAC systems while the propulsion engine is shut down, such as to maintain the temperature in a sleeping cabin or to chill a load, thereby lowering fuel consumption and reducing idle emissions. A boat may have such a system to power an air conditioner when underway or otherwise not on shore power. They are commonly employed on boats without propulsion engines, such as sailboats.

Improvements are continually sought to make engine-generator sets that generate higher amounts of power for a given size, with increased efficiency, reduced emissions and with as little noise as possible.

SUMMARY

One aspect of the invention features an engine-generator set with a diesel engine having a rotatable crankshaft, and an electrical generator with a rotor secured to the crankshaft for rotation, with the rotor cantilevered on an end of the crankshaft. The engine is a single-cylinder engine and has an electrically activatable fuel injector connected to a continuously pressurized fuel supply.

In some cases the engine is a marine engine, preferably designed or modified to meet regulations concerning diesel engines to be operated aboard watercraft.

In some embodiments, the engine defines a cooling passage in hydraulic communication with both a raw water inlet and a raw water outlet into an exhaust system of the engine. The engine may have an exhaust system arranged to receive a flow of exhaust from the single cylinder and to pass the received exhaust through a catalyst, with the cooling passage also in hydraulic communication with a cooling jacket extending at least partially about the catalyst.

In some examples the engine is air-cooled.

In some applications, the engine-generator set is mounted on a vehicle and configured to produce electrical power for powering a cooling system of the vehicle. The engine is preferably mounted with its crankshaft extending horizontally.

In some embodiments, the generator is a variable-speed generator.

In some instances, the generator is a permanent magnet generator.

Some examples also include a sound-attenuating enclosure surrounding the engine and the generator. The engine is preferably mounted to the sound-attenuating enclosure by a vibration isolator.

In some embodiments, the engine has an exhaust system arranged to receive a flow of exhaust from the single cylinder and to pass the received exhaust through a catalyst. The system may also include an oxygen sensor arranged to be exposed to the flow of exhaust and configured to be responsive to oxygen content in the flow.

Another aspect of the invention features an engine-generator set with a diesel engine having a rotatable crankshaft, and an electrical generator with a rotor secured to the crankshaft for rotation, with the rotor cantilevered on an end of the crankshaft. The engine has an electrically activatable fuel injector connected to a continuously pressurized fuel supply, and the engine defines a cooling passage in hydraulic communication with both a raw water inlet and a raw water outlet into an exhaust system of the engine.

In some embodiments, the exhaust system is arranged to receive a flow of exhaust from the single cylinder and to pass the received exhaust through a catalyst, and wherein the cooling passage is also in hydraulic communication with a cooling jacket extending at least partially about the catalyst. The system may also include an oxygen sensor arranged to be exposed to the flow of exhaust and configured to be responsive to oxygen content in the flow.

In some examples the engine is air-cooled.

In some applications, the engine-generator set is mounted on a boat and configured to produce electrical power for powering a cooling system of the boat. Preferably, the engine is mounted with its crankshaft extending horizontally.

In some cases, the generator is a variable-speed generator.

In some instances, the generator is a permanent magnet generator.

The engine-generator set may also include a sound-attenuating enclosure surrounding the engine and the generator. The engine is preferably mounted to the sound-attenuating enclosure by a vibration isolator.

The invention described herein can be employed to provide a diesel generator producing a reasonable amount of power (e.g., 5 kilowatts) in a compact volume, with minimal airborne noise and while meeting today's strict emissions standards, both in the United States (as promulgated by the EPA) and in Europe and other parts of the world.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
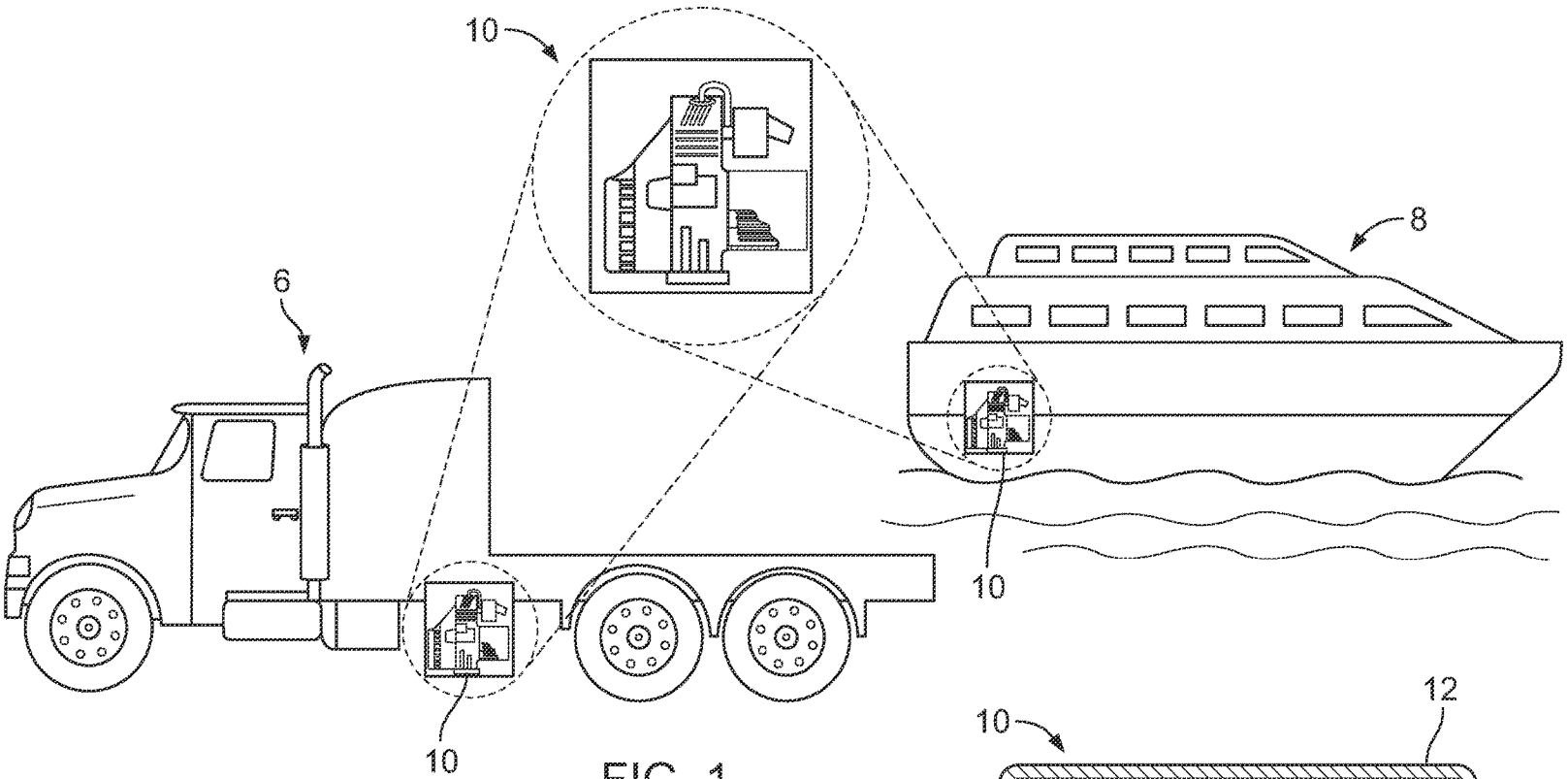
FIG. 1 is an illustration of a truck and a boat, each including an auxiliary engine-generator set for powering onboard systems.

Referring first to FIG. 1, an on-road vehicle 6 and a boat 8 are each shown with an enclosed diesel engine-generator set 10 configured to consume diesel fuel to produce electrical power that can be provided directly to on-board systems such as HVAC equipment, or stored in one or more on-board batteries (not shown) for later use. Fuel may be provided from a tank that also feeds a propulsion engine, or from a separate tank. The vehicle-mounted and boat-mounted engine-generator sets meet the additional federal guidelines and requirements for on-road and marine use, respectively. They are each preferably enclosed in a sound-dampening enclosure 12, as discussed below with respect to FIG. 2.

Figure 2:
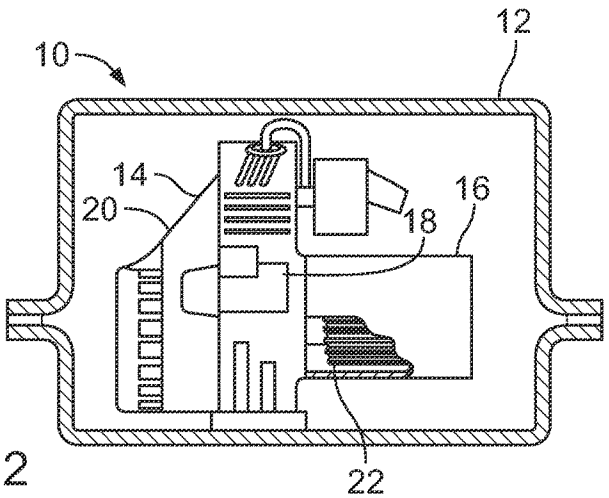
FIG. 2 is a side cutaway view of an enclosed engine-generator set, with the generator mounted to the engine on a side opposite the flywheel.

Referring to FIG. 2, enclosure 12 completely surrounds the engine 14 and generator 16 of the engine-generator set, other than for fuel and combustion air inlets, an exhaust outlet, cooling water inlet and outlet, and electrical cables (not shown). The enclosure has a base and a removable cover, for accessing the engine and generator for service. The entire unit, including the enclosure, preferably has a volume of less than about one cubic meter. The engine-generator set is mounted within the enclosure on vibration isolators, and the enclosure itself may be mounted on isolators, to minimize vibration coupling to the boat or vehicle.

The engine 14 is preferably a one-cylinder diesel engine, such as a Model 178/186 available from various sources including Chang Chai, or a Model L70/L100 engine from Yanmar. It includes at least one solenoid-actuated fuel injector, electronically controlled by an engine controller (not shown) to inject timed bursts of fuel into the single cylinder, preferably multiple bursts per cycle from a fuel line held at a pressure of 10 to 20 ksi (70 to 140 MPa). The injector is controlled such that the timing and amount of fuel are optimal for minimizing emissions under sensed power output and speed conditions. The engine-generator set should be able to produce 5 kW of continuous AC power at 50 or 60 Hz and 120 or 240 volts, meeting U.S. EPA and European emissions standards for marine and vehicle use. The engine may be configured for air cooling or liquid (e.g., water) cooling. If air-cooled, the enclosure will provide for a cooling air inlet and outlet. If the engine is cooled by a closed loop liquid circuit, the enclosure will provide for a coolant inlet and outlet connected to an external radiator. If the engine is marinized and cooled by raw water, the enclosure will provide for a seawater inlet.

The engine is started by an electric starting motor. In some cases the generator is also configured to serve as the starting motor. Alternatively, a separate starting motor 18 may be mounted to drive the crankshaft of the engine, such as through a flywheel. In this example, the generator 16 is mounted at an end of the crankshaft opposite the flywheel, which is enclosed in a shroud 20. The generator rotor 22 is rigidly coupled to the crankshaft and cantilevered, such that there is no bearing supporting the rotor other than through the crankshaft.

Figure 3:
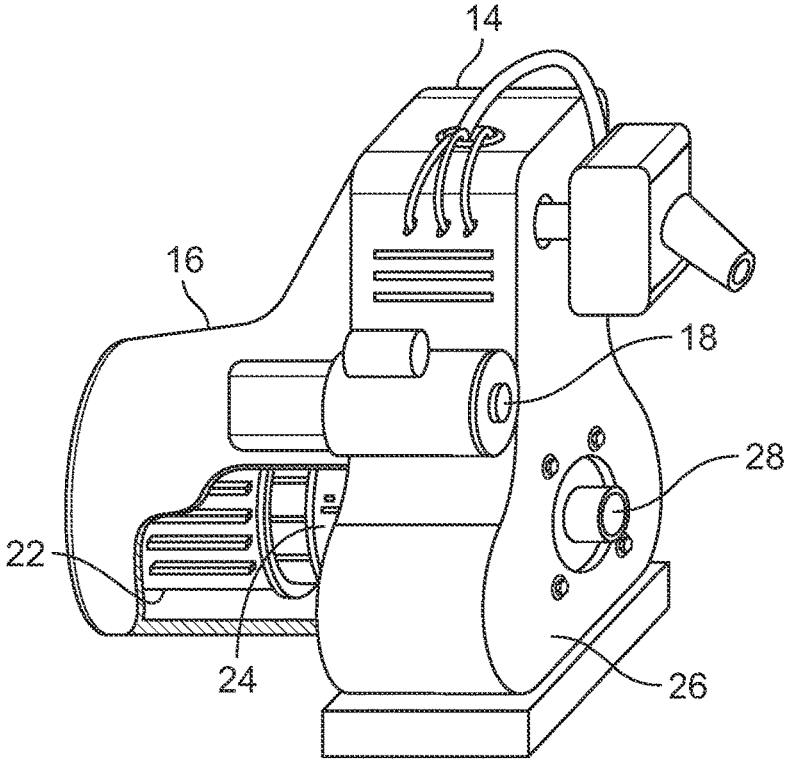
FIG. 3 is a perspective view of an engine-generator set, with the generator mounted to the engine at the flywheel end of the crankshaft.

Alternatively, the generator can be mounted on what would be the flywheel end of the crankshaft, as shown in FIG. 3. In this configuration, the generator rotor 22 is again rigidly coupled to the crankshaft and cantilevered. That is, the crankshaft 28 and the generator rotor are together supported by rotation only by bearings supported by the engine block 26. In this illustrated example, a flywheel 24 is also secured to the crankshaft and rotor, and engaged by starter motor 18 to start the engine. Alternatively, the generator rotor 22 may have sufficient inertia to serve as the engine flywheel, and starting can be accomplished by driving the generator electrically (such as by providing a separate starting winding in the generator). In the configuration of FIG. 3, the opposite end of crankshaft 28 remains available to drive another component or system. In both illustrated configurations, the cylinder bore is arranged vertically to provide a small engine footprint.

Figure 4:
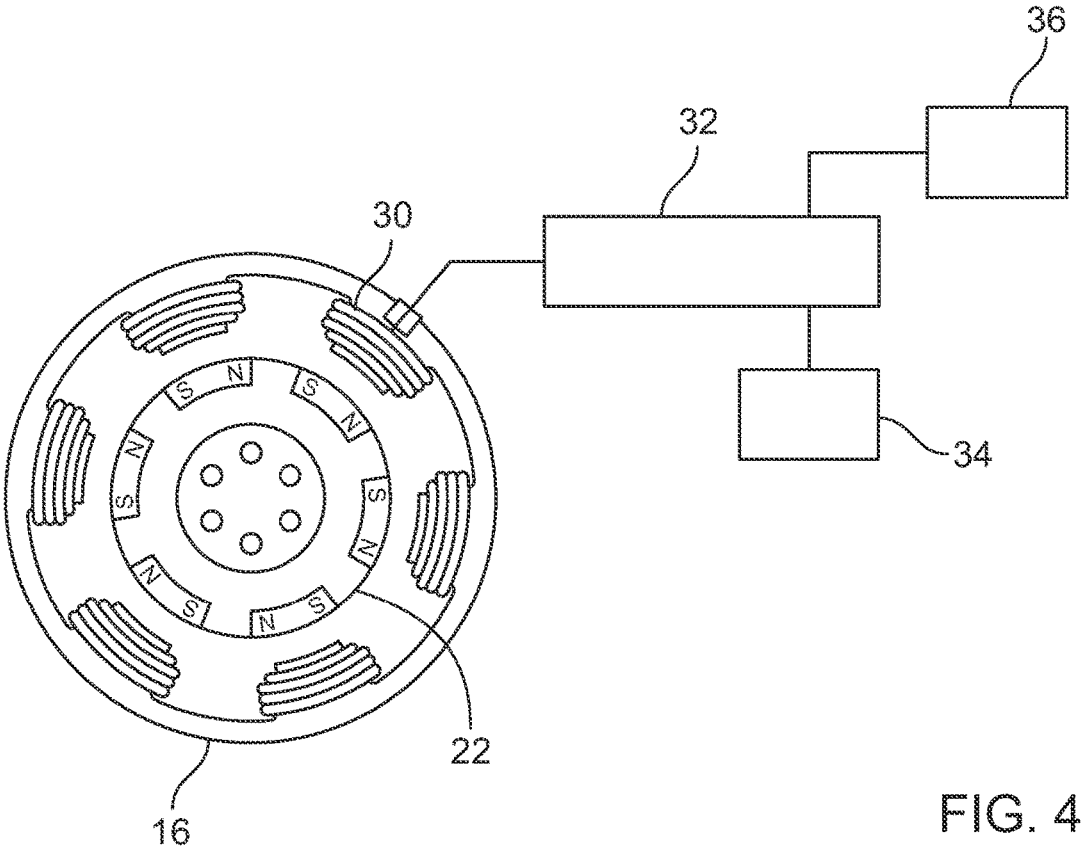
FIG. 4 is a schematic representation of a cross-section of a permanent magnet generator, coupled to an inverter/rectifier and battery.

Referring next to FIG. 4, generator 16 is preferably a high efficiency, permanent magnet generator (PMG). The stator coils 30 send electrical power to an inverter/rectifier 32 coupled to a battery 34 for storage and to an AC main circuit 36 from which onboard systems may be powered. Inverter/rectifier 32 works at variable generator speeds, allowing the asynchronous generator to run at lower speeds at lower loads, for lower overall noise. The engine-generator is electronically governed in order to provide rapid speed and fuel fluctuations in response to rapid load changes. Preferably, the generator speed is controlled in accordance with a table of discrete speed steps, to avoid continuous noise changes from minor speed fluctuations. While the generator is illustrated as elongated, for many applications the generator may be shorter than the diameter of the stator, providing a low overall system footprint and lower bearing loads. The rotor 22 carries rare earth permanent magnets for high energy density.

Alternatively, the generator may be a synchronous PMG operating at a constant speed and providing output power at the desired frequency.

Figure 5:
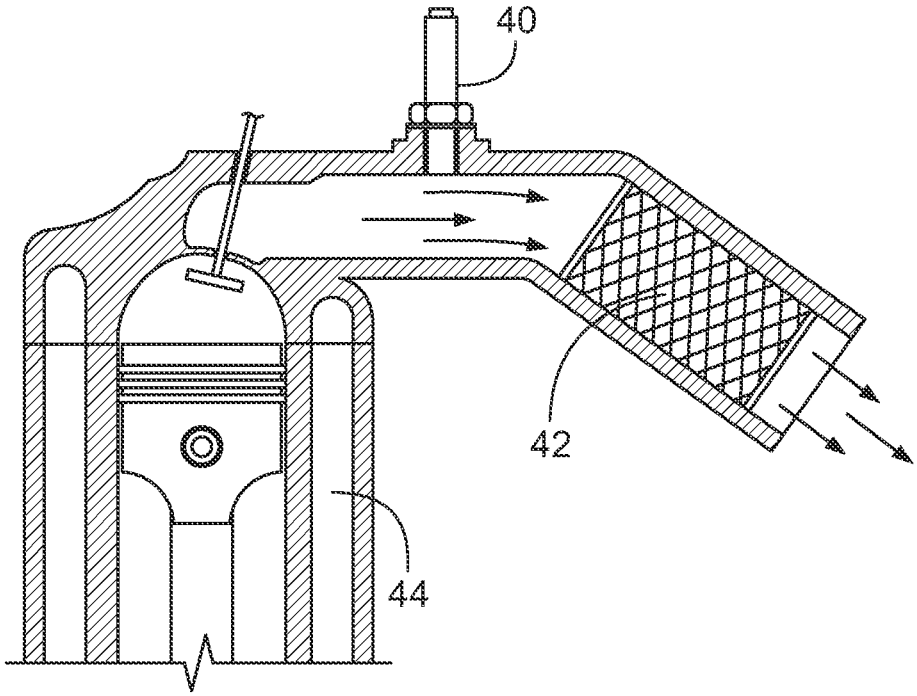
FIG. 5 illustrates a dry exhaust, such as on a road vehicle.

Referring next to FIG. 5, in a road vehicle application the cylinder exhaust is routed past an oxygen sensor 40 and through a catalyst bed 42 that oxidizes unwanted exhaust components. This engine is shown to be liquid-cooled, with cooling channels 44 defined in the engine block for removing heat to a remote radiator.

Figure 6:
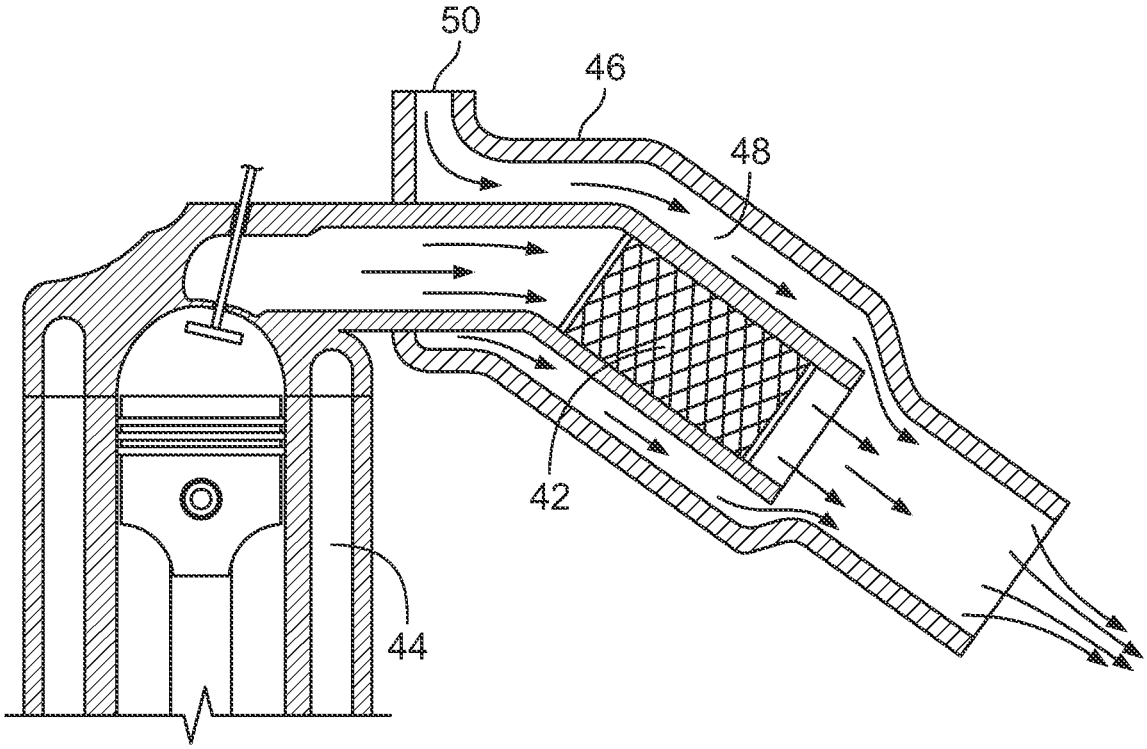
FIG. 6 illustrates a wet exhaust, such as on a boat.

Referring to FIG. 6, in a marine application the cylinder exhaust may be routed through a catalyst bed 42 within an injection elbow 46, such that downstream of the catalyst bed the exhaust flow merges with a flow of raw water 48 from a water inlet 50, and the wet exhaust is routed to an exit, either above or below the water line. An oxygen sensor may also be included, as in the above-described road vehicle application, upstream of the injection elbow.

While a number of examples have been described for illustration purposes, the foregoing description is not intended to limit the scope of the invention, which is defined by the scope of the appended claims. There are and will be other examples and modifications within the scope of the following claims.

What is claimed is:

1. An engine-generator set comprising:

a diesel engine with a rotatable crankshaft; and an electrical generator with a rotor secured to the crankshaft for rotation, the rotor cantilevered on an end of the crankshaft;

wherein the engine is a single-cylinder engine and has an electrically activatable fuel injector connected to a continuously pressurized fuel supply; and wherein the engine has an exhaust system arranged to receive a flow of exhaust from the single cylinder and to pass the received exhaust through a catalyst.

2. The engine-generator set of claim 1, wherein the engine is a marine engine.

3. The engine-generator set of claim 1, wherein the engine defines a cooling passage in hydraulic communication with both a raw water inlet and a raw water outlet into the exhaust system of the engine.

4. The engine-generator set of claim 1, wherein the cooling passage is also in hydraulic communication with a cooling jacket extending at least partially about the catalyst.

5. The engine-generator set of claim 1, wherein the engine is air-cooled.

6. The engine-generator set of claim 1, wherein the engine-generator set is mounted on a vehicle and configured to produce electrical power for powering a cooling system of the vehicle.

7. The engine-generator set of claim 6, wherein the engine is mounted with its crankshaft extending horizontally.

8. The engine-generator set of claim 1, wherein the generator is a variable-speed generator.

9. The engine-generator set of claim 1, wherein the generator is a permanent magnet generator.

10. The engine-generator set of claim 1, further comprising a sound-attenuating enclosure surrounding the engine and the generator.

11. The engine-generator set of claim 10, wherein the engine is mounted to the sound-attenuating enclosure by a vibration isolator.

12. The engine-generator set of claim 1, further comprising an oxygen sensor arranged to be exposed to the flow of exhaust and configured to be responsive to oxygen content in the flow.

13. An engine-generator set comprising:

a diesel engine with a rotatable crankshaft; and an electrical generator with a rotor secured to the crankshaft for rotation, the rotor cantilevered on an end of the crankshaft;

wherein the engine has an electrically activatable fuel injector connected to a continuously pressurized fuel supply; and wherein the engine defines a cooling passage in hydraulic communication with both a raw water inlet and a raw water outlet into an exhaust system of the engine; and wherein the engine exhaust system is arranged to receive a flow of exhaust and to pass the received exhaust through a catalyst.

14. The engine-generator set of claim 13, further comprising an oxygen sensor arranged to be exposed to the flow of exhaust and configured to be responsive to oxygen content in the flow.

15. The engine-generator set of claim 13, wherein the engine is air-cooled.

16. The engine-generator set of any of claim 13, wherein the engine-generator set is mounted on a boat and configured to produce electrical power for powering a cooling system of the boat.

17. The engine-generator set of claim 16, wherein the engine is mounted with its crankshaft extending horizontally.

18. The engine-generator set of claim 13, wherein the generator is a variable-speed generator.

19. The engine-generator set of claim 13, wherein the cooling passage is also in hydraulic communication with a cooling jacket extending at least partially about the catalyst.

* * * * *